US005254376A

United States Patent [19]

Grosslight

[11] Patent Number: 5,254,376

[45] **Date of Patent: * Oct. 19, 1993**

[54] GRAPHIC COMMUNICATION MEDIUM

[76] Inventor: Jane S. Grosslight, 700 North Ride, Tallahassee, Fla. 32303

[ * ] Notice: The portion of the term of this patent subsequent to Sep. 19, 2006 has been disclaimed.

[21] Appl. No.: 412,792

[22] Filed: Sep. 26, 1989

[51] Int. Cl.[5] ..... B44C 1/22

[52] U.S. Cl. ..... 428/29; 427/11; 427/264; 434/346

[58] Field of Search ..... 283/72, 102; 427/11, 427/264; 434/85, 346; 428/29, 542.8, 916

[56] References Cited

U.S. PATENT DOCUMENTS

| | | | |
|---|---|---|---|
| 471,305 | 3/1892 | Tschofen | 428/29 |
| 761,001 | 5/1904 | Lebateux | 428/29 |
| 775,747 | 11/1904 | Doberenz | 428/29 |
| 2,065,266 | 12/1936 | Connelly | 428/84 X |
| 3,607,341 | 9/1971 | Goins et al. | 428/262 |
| 3,880,360 | 4/1975 | Peng et al. | 241/24 |
| 3,920,870 | 11/1975 | Ackerman et al. | 428/46 |
| 3,953,643 | 4/1976 | Cheung et al. | 428/463 X |
| 3,983,277 | 9/1976 | Ackerman et al. | 428/46 |
| 4,161,564 | 7/1979 | Legbandt | 428/383 X |
| 4,284,453 | 8/1981 | Endrizzi | 428/151 X |
| 4,374,691 | 2/1983 | Vanden Bergh | 428/206 X |
| 4,379,805 | 4/1983 | Downing et al. | 428/206 X |
| 4,505,974 | 3/1985 | Hosler | 428/329 |
| 4,591,190 | 5/1986 | Clark | 283/102 |
| 4,597,591 | 7/1986 | Gendron et al. | 283/102 X |
| 4,677,553 | 6/1987 | Roberts et al. | 364/412 |
| 4,868,020 | 9/1989 | Grosslight | 428/29 |
| 5,089,351 | 2/1992 | Baarns | 427/11 X |
| 5,173,324 | 12/1992 | Newhart | 427/11 |

OTHER PUBLICATIONS

The Thames & Hudson Dictionary of Art Terms p. (4).
The Penguin Dictionary of Art & Artists p. (1).

*Primary Examiner*—Henry F. Epstein
*Attorney, Agent, or Firm*—Hopkins & Thomas

[57] ABSTRACT

A graphic communication medium is disclosed in which a dry pastel substance is placed in solution and uniformly applied over a substrate such as paper. The substrate may include a drawing beneath the pastel such that areas of the drawing may be highlighted by selectively removing the dried pastel from the area to be highlighted. The highlighted area is then re-covered by rubbing pastel from adjacent areas of the substrate thereover.

19 Claims, No Drawings

GRAPHIC COMMUNICATION MEDIUM

BACKGROUND OF THE INVENTION

It is very difficult to communicate information satisfactorily using only words. Pictures communicate information better. This invention makes pictures easy to produce. For instance, many professionals in the field of lighting design have experimented with graphics to show what lighting would look like in a space. Up to this point, their efforts have resulted in laborious graphics which are not easily utilized because of skill, time and/or money investments required to produce such graphics. Rub and show graphics were discovered during searches for an easy-to-produce and an easy-to-change graphic suitable for minimal artistic-skill users. This invention solves a graphic problem in the field of lighting design.

Likewise, professionals in the fields of art or graphic communication have not used pastels in this way. They have used pastels to put down colors in order to create an image, have struggled to make sure that the pastels stuck to the paper and that the pastels did not smudge. This invention puts down a single color not to create an image, but to shade. This invention smudges the pastels purposefully and does not want the pastels to stick to the paper, since the overlay is removed by the user and the paper surface must appear to be free of the overlay. This invention clearly is a unique use of products already available for a useful purpose unanticipated before this invention. People who have used this invention were surprised at the end product possible and its uses.

SUMMARY OF THE INVENTION

This invention pertains to the field of graphic arts and graphic communication. The principal use of this invention is to be able to communicate graphically and to be able to change the graphics easily. This invention is a treatment consisting of a translucent overlay of one color of pastels applied uniformly to a piece of paper which can be erased by the user leaving the original color of the paper showing or highlighting an image graphically. The overlay can be rubbed back to uniform if the user does not like the first image and it can be erased again to show a different image. This renewal process can be done several times, depending upon the length of time stored and the temperature and humidity conditions of storage.

This invention solves the disadvantages of previous methods by being quick and easy to use, by not demanding training or skill, and by not entailing complex equipment. It will permit people without skill to express themselves graphically.

Likewise, Rub and show has not been anticipated by the other uses to which other people have used pastels prior to my invention. Prior methods of graphic communication required training or skill. Drawing requires training or skill to create pictures on paper. Heretofore, pastel pictures required artistic skill. The pastels are applied in single or multiple layers to create an image. This invention applies a single color and has the user remove areas of the color to create the desired image by highlighting. This method is not substantially taught in the field of art or graphics. Therefore, it is not obvious. This invention does not require artistic skill and will permit many more people to create graphic images.

Computer-generated graphics require training or skill. Images created on a cathode ray tube demanded electronic machinery and software to be accomplished. This invention does not depend upon electronic machinery and software. It utilizes a readily available and inexpensive implement, an eraser.

The prior method of drawing by applying areas of color to create an image on paper can not be easily changed. The prior method of computer-generated graphics can be easily changed but only if the user knows how and the machinery is operable. With this invention, the image can be changed easily and changed several times. The ability to change produces a new and unexpected result. The ability to change is particularly impressive in a sales situation.

Contrary to prior methods which add a color to accomplish highlighting, this invention creates highlighting by removal.

This invention produces a new function and the interaction of the parts is necessary for the end result. It is more than an aggregation. This invention is capable of performing a function and is able to produce good and satisfactory results. The function it performs is to allow people untrained in graphics, by hand or by computer, to produce something graphically with no more skill than being able to erase.

This invention could be used in education or in commerce. In education, it could be used for tests or for homework. For example, school children with or without skill in art could indicate by erasure the states that were part of the Louisiana Purchase on paper with this treatment and printed with a map of the United States. Further, they could change it, if they did not like their first answer.

In commerce, prior art has been a visible opaque overlay to make an image on the paper invisible. The overlay had to be scraped off with a hard instrument and was not renewable. Or, prior art has been an invisible opaque overlay, which when rubbed off was not renewable.

In addition, this invention could be used for sales demonstrations. For example, lighting showroom staff could demonstrate for a customer what the lighting would look like in a living room by using an eraser on paper treated with this method and imprinted with a drawing of a typical living room. Also, the showroom staff could easily change the image of the lighting, if the customer did not like the first one.

Furthermore, this invention could be used by management to indicate projections for a board meeting showing growth and expansion right before the board members' eyes. This invention has may educational and many commercial applications. The rub and show graphics are a new utility to solve an age-old problem of making communication more explicit. It is inventive and distinctive. It is a novel solution. It has not been anticipated and has practical uses. It has several advantages over prior methods. One advantage is that it can permit more people to express themselves graphically, not just a few with artistic or computer skill. A second advantage is that the graphic product can be accomplished quickly, not laboriously like most graphics. A third advantage is that it gives the user the option to restore and recreate a new image after the first attempt.

DETAILED DESCRIPTION OF THE PREFERRED EMBODIMENT

Rub and show graphics are made by applying uniformly a translucent overlay of pastels, (such as Nupastel®, Eberhard Faber, Wilkes-Barre, Pa.) in a visible and in a different color than the surface of a suitable substrate, such as good quality paper (usually 50 pound offset paper or better). The paper can be previously imprinted by electrostatic or by printing process (preferably electrostatic) with words, numbers, or a line drawing before being treated with the overlay. The overlay is lightly and evenly rubbed with a cloth or buffing pad by hand or by machine in order to have it adhere to, but not to sink into, the surface of the paper. The overlay shades the paper. The overlay is translucent and allows the user to easily see the previously imprinted image, if there is one. The user of the graphics can erase the overlay leaving the ground free of the overlay to create an area of highlights by revealing the original color of the surface of the paper and any printed image on the paper. The previous imprint can be a frame of reference or the reason for the area erased. The overlay is removed by erasing with a soft eraser (such as Pink Pearl® eraser, Eberhard Faber, Wilkes-Barre, Pa.). If the user is not pleased with the resulting image created by the highlights and/or the information conveyed by the highlights, the user can change the highlights by rubbing the overlay back to uniform with a soft cloth or paper tissue and erase it again to create a different image of highlights. The user can successfully rub the overlay back to uniform again one to three times more, depending upon the length of time the paper with the overlay has been stored and the temperature and humidity of the storage.

Another method of application of the pastel to the paper involves suspending the pastel in a suitable inorganic or organic solvent, such as water, alcohol, ethyl acetate, acetone, or other liquid medium that does not leave a residue upon evaporation. A suitable surfactant, such as a detergent, for example, can be added to the solution to aid in keeping the pastel in suspension.

Application of the wet solution may be accomplished in any suitable manner, such as by spraying the solution on to a continuous roll of paper. Drying the paper is done in a conventional manner, and the paper may be pressed flat during the drying operation to ensure consistency. After the pastel solution has dried on the paper, the pastel can be rubbed or brushed, if necessary, to distribute the pastel evenly over the paper surface. Excess pastel, if any, is collected and re-used.

Thus, while an embodiment of a graphic illustration tool and a method of producing same and modifications thereof have been shown and described in detail herein, various additional changes and modifications may be made without departing from the scope of the present invention.

I claim:

1. A graphic communication device comprising a sheet of paper having a front and back surface with a uniformly applied layer of dry pastel substance, said pastel substance being suspended in solution for application to said paper, said pastel substance being infused onto said front surface and being selectively removable therefrom, said pastel being translucent and of a uniform color different from that of said paper such that, when removed, a contrast is presented between said paper and said pastel layer, said pastel also being applied in a thickness sufficient to permit re-covering of said front surface by spreading said dry pastel over the area from which it was removed.

2. A graphic communication device as defined in claim 1 in which said paper includes a graphic design permanently imprinted on said paper prior to application of said pastel layer.

3. A graphic communication device as defined in claim 1 in which said pastel substance is of a darker hue than that of said paper.

4. A graphic communication device as defined in claim 1 in which said solution includes a solvent.

5. A graphic communication device as defined in claim 4 in which said solvent is organic.

6. A graphic communication device as defined in claim 4 in which said solvent is inorganic.

7. A graphic communication device as defined in claim 4 in which said solution includes a surfactant.

8. A graphic communication device as defined in claim 1 in which said solution includes a surfactant.

9. A method of graphic communication comprising the steps of:

a) suspending a pastel substance in solution;

b) applying a uniform layer of said solution to one surface of a sheet of paper;

c) selectively removing areas of said pastel for creating a contrast between the paper and pastel and highlighting areas of said paper;

d) rubbing the pastel remaining on the paper over the area of the paper from which it was removed with a cloth or the like for re-covering the paper with the pastel remaining on the paper and eliminating the previously created highlighted area; and e) repeating steps c) and d) for selectively highlighting areas of said paper.

10. A method of graphic communications as defined in claim 9 including the additional step of imprinting a graphic design on said paper prior to applying said pastel in said step a).

11. A method of graphic communication as defined in claim 9 in which said removal of said pastel in said step c) is accomplished by rubbing an eraser over the area to be highlighted.

12. A method of graphic communication as defined in claim 9 in which said solution includes a solvent.

13. A method of graphic communication as defined in claim 12 in which said solvent is organic.

14. A method of graphic communication as defined in claim 12 in which said solvent is inorganic.

15. A method of graphic communication as defined in claim 12 in which said solution includes a surfactant.

16. A method of graphic communication as defined in claim 9 in which said solution includes a surfactant.

17. A method of preparing a graphic communication medium having as a characteristic a substrate with a coating of a dry pastel substance, said substance having a thickness sufficient to permit selective removal of one or more selected areas of said coating and later recovering of said selected area or areas by spreading the remaining substance over the area from which it had been removed comprising the steps of:

a) suspending in solution a pastel substance;

b) applying said pastel substance in solution to the surface of a substrate;

c) allowing said solution to dry, leaving a dry pastel substance coating said substrate, said substance being selectively removable therefrom.

18. A method of preparing a graphic communication medium as defined in claim 17 in which said solution includes a component selected from the group consisting of organic and inorganic solvents.

19. A method of preparing a graphic communication medium as defined in claim 17 in which said solution includes a surfactant.

* * * * *